US006056416A

United States Patent [19]

Ngai et al.

[11] Patent Number: 6,056,416

[45] Date of Patent: May 2, 2000

[54] INDIRECT LUMINAIRE HAVING AN UPPER REFLECTOR FOR IMPROVED BRIGHTNESS CONTROL

[75] Inventors: Peter Y.Y. Ngai, Alamo; Hue Ly, Richmond, both of Calif.

[73] Assignee: NSI Enterprises, Inc., Atlanta, Ga.

[21] Appl. No.: 08/890,783

[22] Filed: Jul. 11, 1997

Related U.S. Application Data

[60] Provisional application No. 60/021,538, Jul. 11, 1996.

[51] Int. Cl.[7] ..... F21S 3/00

[52] U.S. Cl. ..... 362/225; 362/309; 362/327

[58] Field of Search ..... 362/225, 217, 362/404, 301, 309, 339, 224, 327, 246

[56] References Cited

U.S. PATENT DOCUMENTS

| | | | |
|---|---|---|---|
| 4,053,762 | 10/1977 | Barbson | 362/223 |
| 4,680,684 | 7/1987 | Wolber | 362/223 |
| 4,866,584 | 9/1989 | Plewman . | |
| 5,051,878 | 9/1991 | Ngai . | |

*Primary Examiner*—Sandra O'Shea
*Assistant Examiner*—Peggy A. Neils
*Attorney, Agent, or Firm*—Donald L. Beeson

[57] ABSTRACT

An indirect luminaire having a housing with a top opening and a light source in the housing is provided with an exposed lens reflector system positioned over the top opening of the housing for receiving and redirecting source light from a position above the light source. The lensed reflector system includes an outer refracting lens element having a lens surface observable from below the luminaire and a substantially diffuse reflector substrate for the lens element. This system produces a light distribution pattern substantially governed by the internal reflection and refraction characteristics of the lens element and controlled brightness characteristics on the observable lens surface substantially governed by the diffuse reflection characteristics of the reflector substrate. A lens tower is suitably provided for holding the lensed reflective system in its operative position over the top opening of the luminaire housing. Preferably, the lens tower provides the diffuse reflector substrate for the lensed reflector system, with the lens element being removably attached to the lens tower so that the lens element can be readily replaced.

20 Claims, 3 Drawing Sheets

INDIRECT LUMINAIRE HAVING AN UPPER REFLECTOR FOR IMPROVED BRIGHTNESS CONTROL

CROSS-REFERENCE TO RELATED APPLICATION

This application claims the benefit of U.S. Provisional Application No. 60/021,538, filed Jul. 11, 1996.

BACKGROUND OF THE INVENTION

The present invention relates to architectural lighting, and more particularly to luminaires which are suspended or mounted to a building's architecture to provide an indirect lighting environment. The invention still more particularly relates to the practice of introducing source brightness in an indirectly lit space, and the problems associated with providing exposed specular reflector surfaces for this purpose as disclosed in U.S. Pat. No. 4,866,584, issued to Dale Plewman.

The Plewman patent discloses an indirect luminaire having a dual reflector system featuring an exposed upper parabolic reflector positioned close to the light source to spread source light in a wide distribution pattern and to prevent "hot spots" on the ceiling. The exposed reflector of the Plewman luminaire also directs a small amount of source light in a downward direction below the horizontal in order to introduce a source of observable surface brightness to the architectural space below the luminaire. The introduction of an element of visible and controlled source brightness from an exposed optical element of an indirect luminaire is known to counteract the dullness normally associated with indirect lighting and is known to enhance the visual environment.

The problem with the dual reflector system disclosed in the Plewman patent is that the reflecting surfaces of the exposed upper reflector element are specular and very sensitive to positioning errors. Any errors in the positioning of the reflector can lead to "flashing" below the horizontal, that is, the introduction of visible areas of very high luminance within observable viewing angles below the luminaire. Flashes of high luminance on exposed surfaces produce glare on work surfaces and VDT screens, and further produce excessive brightness that will be uncomfortable to look at when viewed directly. Thus, to prevent flashing, the contoured reflector surfaces of the Plewman upper reflector must be precisely positioned and carefully designed and manufactured. Even then, flashing can occur if the upper reflector or the luminaire is moved slightly from its intended position, such as might occur if a maintenance person causes the luminaire to tilt or knocks the upper reflector element slightly out of position. Moreover, if the two symmetric, parabolic surfaces of the Plewman upper reflector are not matched very carefully, there will be a visually noticeable difference in their behavior which will produce an undesirable asymmetry to the luminaire's performance.

The present invention overcomes the disadvantages of using exposed specular reflectors to introduce source brightness to an indirectly lit architectural space, while retaining the advantages of providing an optical control element close to the source of light for spreading the light. The invention provides an indirect luminaire having an upper exposed optical element in close proximity to the light source for controlling light distribution and for providing observable source brightness at viewing angles below the luminaire which is controlled to the point where flashing problems associated with a specular surfaces are virtually eliminated. The present invention also provides an exposed optical control element which can be readily modified to change the light distribution characteristics of the luminaire to meet different lighting application needs.

SUMMARY OF THE INVENTION

Briefly, the present invention involves an indirect luminaire comprised of a housing having a top opening, a light source in the housing, and an exposed upper lensed reflector system positioned above, and in proximity to the light source for controlled redirection of source light laterally of the luminaire. The lensed reflector system includes a combination of an outer refracting lens element affixed to an inner, diffuse reflector substrate to provide a "kicker lens" function as described in prior U.S. Pat. No. 5,051,878 entitled LUMINAIRE HAVING A LENSED REFLECTOR SYSTEM FOR IMPROVED LIGHT DISTRIBUTION CONTROL. In accordance with the invention, the lensed reflector system is positioned relative to the light source to achieve a desired widespread light distribution pattern; it is further positioned to expose its non-specular lens surfaces below the horizontal to provide a controlled source of observable brightness at high viewing angles below the luminaire. The lens element of the lensed reflector system, which is suitably an extruded part, is also preferably removable from its reflector substrate such that the lens can be readily replaced. Such a replaceable lens element will not only facilitate maintenance, such as replacing lenses that might become cracked, but will also permit lenses of varying prism designs, and hence light distribution characteristics, to be used.

It is therefore an object of the present invention to provide an indirect luminaire having an exposed optical element positioned over and in proximity to the light source for controlling the light distribution therefrom, and which at the same time eliminates exposed specular surfaces that can cause glare and uncomfortable brightness. It is a further object of the invention to provide an optical element having lens elements which can be readily exchanged for maintenance purposes or to modify the light distribution characteristics of the luminaire. Still another object of the invention is to provide an indirect luminaire with the optical system as described herein which is relatively easy to manufacture and install and which can be retrofitted to existing indirect luminaire designs. Other objects of the invention will be apparent from the following specification and the accompanying drawings.

DETAILED DESCRIPTION OF THE ILLUSTRATED EMBODIMENT

Figure 1:
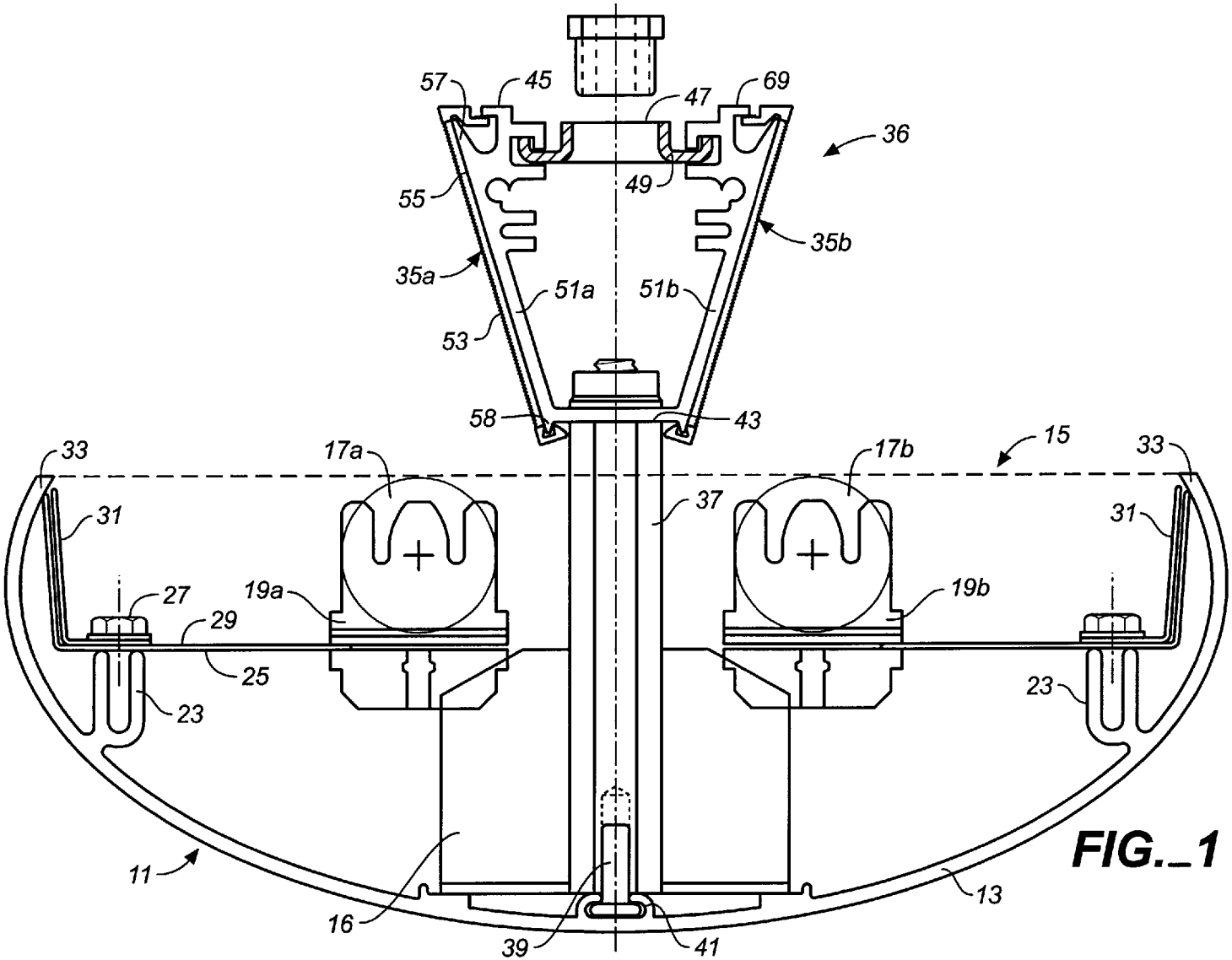
FIG. 1 is a cross-sectional view in side elevation of an indirect luminaire in accordance with the invention.
Figure 2:
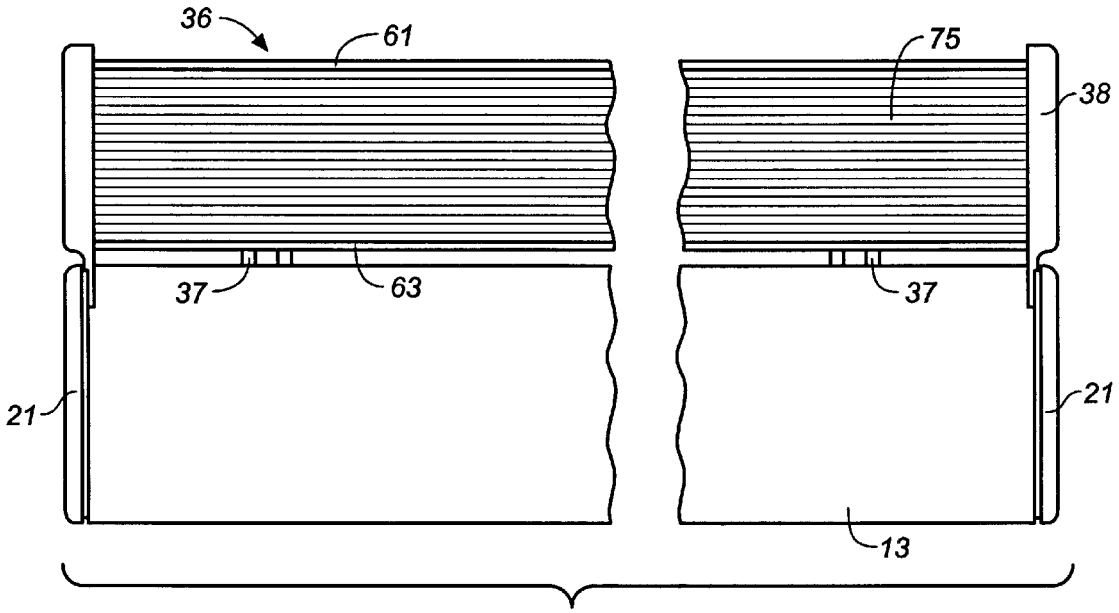
FIG. 2 is a side elevational view thereof.
Figure 3:
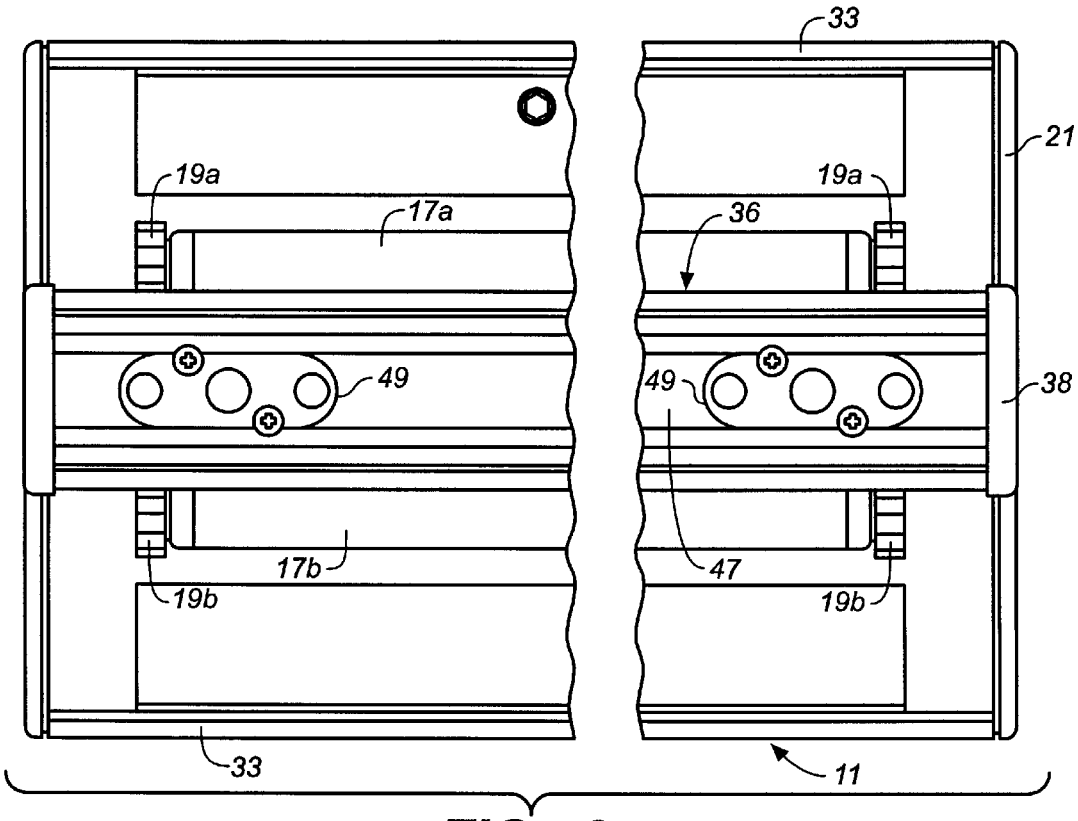
FIG. 3 is a top plan view thereof.

Referring now to FIGS. 1–3 of the drawings, an indirect luminaire, generally denoted by the numeral 11, is seen to include an elongated, suitably extruded aluminum housing 13 having a top opening 15, a ballast 16, and a light source in the form of two fluorescent lamps 17*a,* 17*b* held in the housing by means of lamp sockets 19*a,* 19*b*. The housing is terminated by end caps 21, and includes extruded screw channels 23 onto which bottom reflector 25, which is suitably a white aluminum reflector, can be mounted by means of screw fasteners 27. As best seen in FIG. 1, the bottom reflector, which reflects downwardly directed source light back through the top opening of the housing, includes a flat bottom reflecting surface 29 beneath lamps 17*a,* 17*b,* and vertical reflecting side panels 31 that extend upward just inside the housing side walls 33.

Luminaire 11 is also provided with two elongated upper lensed reflector systems 35*a,* 35*b* supported by means of an upper elongated lens tower 36 positioned above and between lamps 17*a,* 17*b*. The lensed reflector systems are positioned by the lens tower to redirect light received from the top surfaces of the lamps, as well as from the bottom reflectors, in a desired widespread light distribution pattern. It can be seen that lensed reflector system 35*a* generally controls the distribution of light received from lamp 17*a,* while the oppositely directed lensed reflector system 17*b* generally controls the distribution of light from lamp 17*b*. Together these two reflector systems will produce a symmetrical light distribution pattern about the luminaire. In the near field, this distribution pattern will be affected directly overhead the luminaire by the shielding effect of the lens tower. This shielding effect can be taken advantage of to reduce the luminance on ceiling surfaces directly overhead and close to the luminaire. It is believed that the near field shielding function of the lens tower will be effective in reducing the luminance on the ceiling for suspension heights less than approximately three feet.

It is also seen that, because lens tower 36 is positioned above the lamps and at an elevation higher than the housing side walls 33, the surfaces of the lensed reflector systems 35*a,* 35*b* will be visible to persons standing below the luminaire who look at the luminaire at relatively high viewing angles. As further described below, no portion of the exposed surfaces of the two opposed lensed reflector systems will exhibit highly specular characteristics below the horizontal, even if the tower is somewhat out of position, and thus neither system will have a tendency to "flash" if the tower is moved slightly from its desired position.

The lens tower 36 is mounted in its operative position between lamps 17*a,* 17*b* by means of hexagonally shaped mounting posts 37 as shown in FIGS. 1 and 2, and is terminated by end caps 38 as shown in FIGS. 2 and 3. Each mounting post is attached to the bottom of housing 13 by means of a screw fastener 39 engaged in a T-slot 41 extruded in the bottom of the housing. The top end of the mounting posts attach to the tower's bottom wall 43 to hold the tower at its desired elevation.

Tower 36 further includes a top wall structure 45 having a hanger track 47 running the length of the tower. The hanger track is formed to slidably capture suitable hanging hardware 49 to provide for horizontally adjustable hangers from which the luminaire can be suspended. In a manner known in the art, such a hanger track will provide a flexible means of establishing non-feed suspension locations in the overhead ceiling in installations requiring such flexibility.

The tower's inwardly inclined, flat side walls 51*a,* 51*b* provide an essential component of the lensed reflector systems 35*a,* 35*b*. Specifically, each of the lensed reflector systems is comprised of two components, an elongated, extruded lens element 53 and a reflector substrate provided by the flat reflecting surface 55 on each of the tower side walls. Each reflecting surface 55 extends between the side wall's parallel top and bottom edges 57, 58 and should be a diffuse or semi-diffuse reflecting surface, for example, a matte grey surface.

Figure 4:
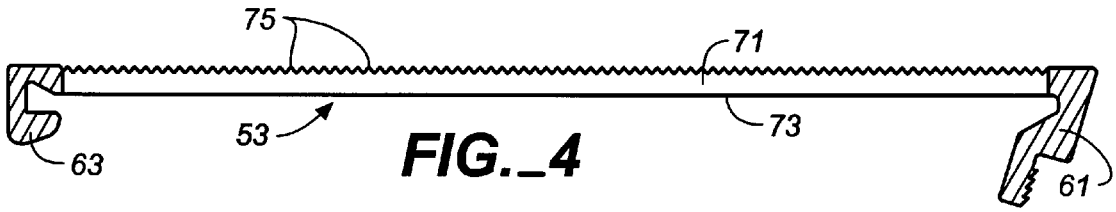
FIG. 4 is a side elevational view of the lens element of the lensed reflector system of the invention.

With reference to FIG. 4, attachment of each of the lens elements to the tower is achieved by means of an inwardly projecting lip 61 which engages top edge 57 of the tower's side walls, and a similarly inwardly projecting, grooved snap ridge 63 which is capable of snapping over the tower side walls' bottom edge 58. Lip 61 includes an extended shoulder portion 65 having a top serrated surface 67 which, as shown in FIG. 1, engages the underside of an outwardly extending locking rim 69 formed on the top wall of the tower. The serrated surface 67 of the lens' lip element 61 will act to hold the lens in place and prevent unintended sliding movement of the lens on the tower.

Figure 4A:
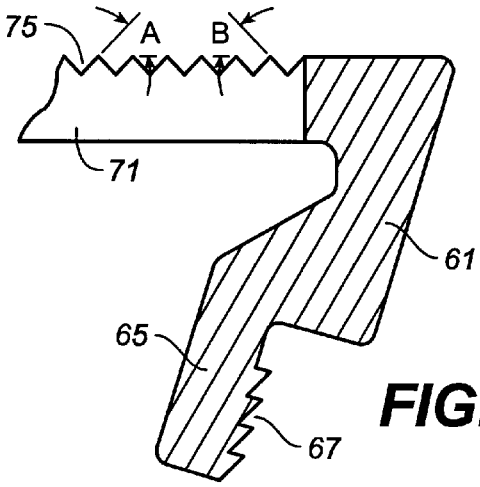
FIG. 4*a* is an enlarged fragmentary view of the top end of the lens element shown in FIG. 4.

As further shown in FIG. 4, each lens element has a defined lens section 71 extending between top lip 61 and bottom snap ridge 63. The lens section is generally defined by an interior flat surface 73 that contacts and is flush with reflecting surface 55 of the tower side walls, and an outer prismatic surface 75 having parallel, longitudinally extending prisms designed to achieve a desired distribution of source light from the luminaire. For example, a suitable light distribution characteristic for a lensed reflector system shown in FIG. 1 can be achieved using a uniform prism design consisting of prisms having 45° prism faces, as denoted by angles "A" and "B" in FIG. 4*a*. The lens element can suitably be an extruded part using CA-81 clear virgin acrylic, and should have sufficient flexibility to permit the lenses to be snapped into place onto the lens tower as above-described. Further, the edges of the lenses, which consist of the bottom snap ridge 63 and top lip 61, are preferably formed by an opaque, suitably flat black, co-extruded material to prevent source light from passing through these edges either directly or through internal reflections.

It will be appreciated that the configuration of the lens tower is such that the only surfaces of the lens tower exposed to an observer below the luminaire are the prismatic surfaces 75 of lens elements 53. The luminance exhibited by these surfaces are more easily controlled than exposed specular surfaces, and any tendency of these exposed surfaces to flash below the horizontal due to positioning errors can be virtually eliminated. Generally, it is desirable to keep the luminance of prismatic surface 75 relatively low, preferably less than 250 footlamberts.

Figure 5:
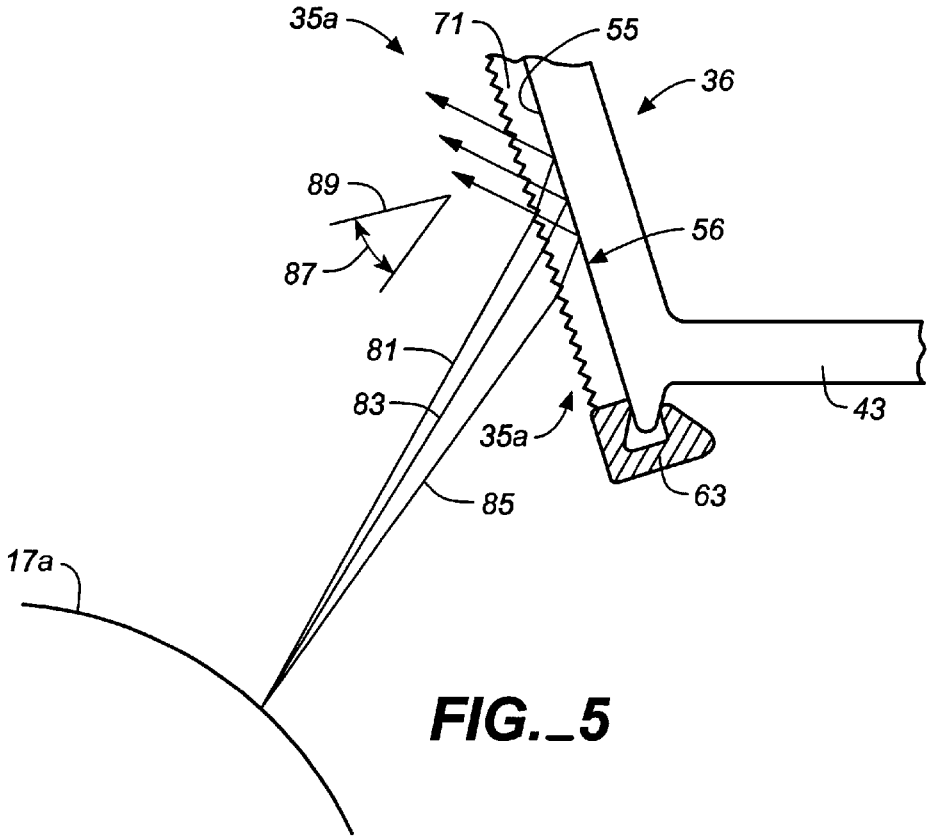
FIG. 5 is a fragmented pictorial view of the lens reflector system of the invention illustrating the light redirecting characteristics thereof.

FIG. 5 pictorially illustrates the light distribution function of the lensed reflector system used in the present invention. Referring to FIG. 5, it can be seen that lensed reflector system 35*a* is positioned such that the bottom of the system is situated in relative close proximity to the top surface of lamp 17*a* at an angle to achieve suitable redirection of the source light. The system receives light from the surface of lamp 17*a,* and redirects this light laterally of the luminaire by a combination of refractive bending of the light and reflection, both internal reflection and reflection from the diffuse reflector substrate 55. The refracting lens acts on the light passing in both directions through the lens, forcing the light to exhibit directional characteristics that would not be achieved by a conventional reflector element. (The general distribution characteristics of such a lensed reflector system is illustrated in the aforementioned U.S. Pat. No. 5,051,878.) More specifically, when the source light reaches the interface 56 of the lens element and reflector substrate at an angle relative to the perpendicular (denoted by line 89) which is greater than a critical angle (denoted by arrow 87), the redirection of light is governed by internal reflections within the lens and has a specular or beamy component as illustrated by ray traces 81, 83, 85. (For CA-81 clear virgin acrylic, the critical angle 87 will be approximately 43°.) On the other hand, when source light arrives at the lens reflector interface at less than the critical angle, the diffuse reflector governs, thereby providing a soft, diffuse component of reflected light. These compound functions, and the ability to design the lens prisms to alter their interactions permit a designer to achieve directionality of the light coming off the lensed reflector system, while controlling the brightness characteristics of the lens surface within a wide range of viewing angles. Thus, the lensed reflector system provides an effective means of controlling light distribution from a position close to the lamps, where greater control can be achieved, without position sensitive specular surfaces.

It will be understood that the indirect luminaire of the present invention can be a totally indirect luminaire or an indirect luminaire that provides some down lighting component in addition to an indirect lighting component.

We claim:

1. An indirect luminaire comprising a housing having a top opening, a light source in said housing, and an exposed lensed reflector system positioned over the top opening of said housing for receiving and redirecting source light laterally of the luminaire from a position above said light source, said lensed reflector system including an outer refracting lens element having a lens surface observable from below the luminaire and a reflector substrate for said lens element, and said lensed reflector system producing a light distribution pattern substantially governed by the internal reflection and refraction characteristics of said lens element and controlled brightness characteristics on said observable lens surface substantially governed by the reflection characteristics of said reflector substrate.

2. The indirect luminaire of claim 1 wherein the lens element of said lensed reflector system has an outer prismatic surface.

3. The indirect luminaire of claim 1 further comprising a lens tower having a sidewall for holding said lensed reflector system, and at least one mounting post for supporting said lens tower over said light source for positioning said lensed reflector system in relation to said light source.

4. The indirect luminaire of claim 3 wherein the sidewall of said lens tower provides the reflector substrate for said lensed reflector system.

5. The indirect luminaire of claim 4 wherein said lens element is removably held to the sidewall of said lens tower whereby lens elements can be readily replaced.

6. An indirect luminaire comprising an elongated housing having a sidewall defining an elongated top opening running substantially the length of said housing, an elongated light source in said housing, an elongated lens tower positioned over the elongated top opening of said housing, said lens tower having at least one elongated side wall and being mounted over and in close proximity to said elongated light source so that the elongated sidewall of said lens tower aligns with said light source, and an elongated lensed reflector system on the sidewall of said lens tower for receiving and redirecting source light from a position above said light source, said lensed reflector system including an elongated outer refracting lens element having a lens surface observable from below the luminaire and a substantially diffuse reflector substrate for said lens element, and said lensed reflector system producing a light distribution pattern substantially governed by the internal reflection and refraction characteristics of said lens element and controlled brightness characteristics on said observable lens surface substantially governed by the diffuse reflection characteristics of said reflector substrate.

7. The indirect luminaire of claim 6 wherein the elongated sidewall of said lens tower provides the reflector substrate for said elongated lensed reflector system.

8. The indirect luminaire of claim 6 wherein the elongated sidewall of said reflector tower has a matte grey surface which acts as the reflector substrate for said lensed reflector system.

9. The indirect luminaire of claim 6 wherein said elongated lens element is removably held to the elongated sidewall of said lens tower whereby lens elements can be readily replaced.

10. The indirect luminaire of claim 9 wherein the elongated sidewall of said lens tower has top and bottom edges and wherein the elongated lens element of said lensed reflector system is formed to snap over and be held by the top and bottom edges of said lens tower sidewall.

11. The indirect luminaire of claim 10 wherein said elongated lens element has a lip portion formed to engage one of the edges of said tower sidewall and a snap ridge portion for snapping over the other of the edges of said tower sidewall.

12. The indirect luminaire of claim 11 wherein said lip portion has a serrated surface for contacting said tower when said lip portion engages an edge of said tower sidewall whereby said lens element is inhibited from sliding on said tower.

13. The indirect luminaire of claim 11 wherein the lip portion and snap ridge portion of said lens element are opaque to prevent source light from passing therethrough.

14. The indirect luminaire of claim 6 wherein said elongated lensed reflector system receives and redirects source light laterally of the luminaire over substantially the entire length of said housing.

15. The indirect luminaire of claim 6 wherein said lens tower is an extruded part.

16. An indirect luminaire comprising an elongated housing having a sidewall defining an elongated top opening running substantially the length of said housing, an elongated light source in said housing, an elongated lens tower positioned over the elongated top opening of said housing, said lens tower having at least one inwardly inclined elongated side wall and being mounted over and in close proximity to said elongated light source so that the elongated sidewall of said lens tower aligns with said light source and so that the inclined tower sidewall generally faces said housing sidewall, and an elongated lensed reflector system on the inclined sidewall of said lens tower for receiving and redirecting source light laterally of the luminaire over said housing sidewall from a position above said light source, said lensed reflector system including an elongated outer refracting lens element having a lens surface observable from below the luminaire and a substantially diffuse reflector substrate for said lens element, and said lensed reflector system producing a laterally directed light distribution pattern substantially governed by the internal reflection and refraction characteristics of said lens element and controlled brightness characteristics on said observable lens surface substantially governed by the diffuse reflection characteristics of said reflector substrate.

17. An indirect luminaire comprising an elongated housing having opposed sidewalls defining a top opening running substantially the length of said housing, an elongated light source in said housing, an elongated lens tower positioned over the top opening of said housing, said lens tower having at least two oppositely directed inwardly inclined elongated side walls and being mounted over and in close proximity to said elongated light source so that the elongated sidewalls of said lens tower align with said light source and so that the oppositely directed tower side walls generally face the opposed sidewalls of said housing, and an elongated lensed reflector system on each of the inclined sidewalls of said lens tower for receiving and redirecting source light laterally over both housing sidewalls from a position above said light source, each of said lensed reflector systems including an elongated outer refracting lens element having a lens surface observable from below the luminaire and a substantially diffuse reflector substrate for said lens element, and each said lensed reflector system producing a laterally directed light distribution pattern substantially governed by the internal reflection and refraction characteristics of said lens element and controlled brightness characteristics on said observable lens surface substantially governed by the diffuse reflection characteristics of said reflector substrate.

18. The indirect luminaire of claim 17 wherein the elongated sidewalls of said lens tower provide the reflector substrate for said elongated lensed reflector systems.

19. The indirect luminaire of claim 17 wherein said elongated lens elements are removably held to the elongated sidewalls of said lens tower whereby lens elements can be readily replaced.

20. The indirect luminaire of claim 19 wherein said lens tower is an extruded part.

* * * * *